US006581784B1

(12) United States Patent
Pino

(10) Patent No.: US 6,581,784 B1
(45) Date of Patent: Jun. 24, 2003

(54) MOTORCYCLE STAND

(75) Inventor: John T. Pino, Auburn, WA (US)

(73) Assignee: JIP Enterprises LLC, Auburn, WA (US)

( * ) Notice: Subject to any disclaimer, the term of this patent is extended or adjusted under 35 U.S.C. 154(b) by 0 days.

(21) Appl. No.: 10/081,651

(22) Filed: Feb. 21, 2002

(51) Int. Cl.[7] ..... A47F 7/00; B66F 3/00
(52) U.S. Cl. ..... 211/22; 254/131
(58) Field of Search ..... 211/22, 17; 254/131; 269/296

(56) References Cited

U.S. PATENT DOCUMENTS 4,113,235 A * 9/1978 Hartman ..... 254/131
4,180,253 A * 12/1979 Ivers et al. ..... 211/22 X
4,193,582 A * 3/1980 Neilsen ..... 254/131
4,348,010 A * 9/1982 Baxter ..... 254/131
5,601,277 A * 2/1997 Larson ..... 254/131
6,015,254 A * 1/2000 Keeler ..... 254/131 X
6,056,272 A * 5/2000 Sayler ..... 254/131
6,234,452 B1 * 5/2001 Johnson ..... 254/131
6,341,763 B1 * 1/2002 Lefebvre ..... 254/131

OTHER PUBLICATIONS

Marlin's Motorcycles, Web Site, 6 pages, Jul. 2, 2001.*
Cylclelifts.com, Certerstad, Donshalld Enterprises, 9 pages, not dated.*

* cited by examiner

*Primary Examiner*—Robert W. Gibson, Jr.
(74) *Attorney, Agent, or Firm*—Jensen & Puntigam, P.S.

(57) ABSTRACT

A stand for elevating the wheel of a motorcycle, which includes a pair of interconnected parallel side plates, including substantially coplanar adjacent flat surfaces. A lever moves the stand from a first non-operative position on one flat surface to a second operative position on the second flat surface, elevating the cycle and further stabilizing the stand in this position.

2 Claims, 4 Drawing Sheets

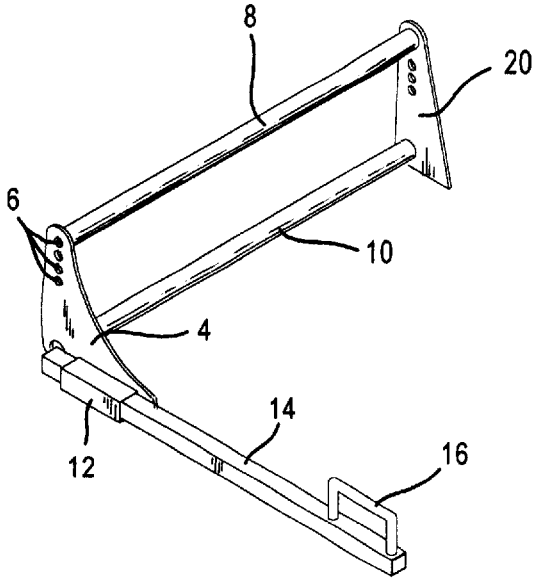
FIG.4
FIG.5
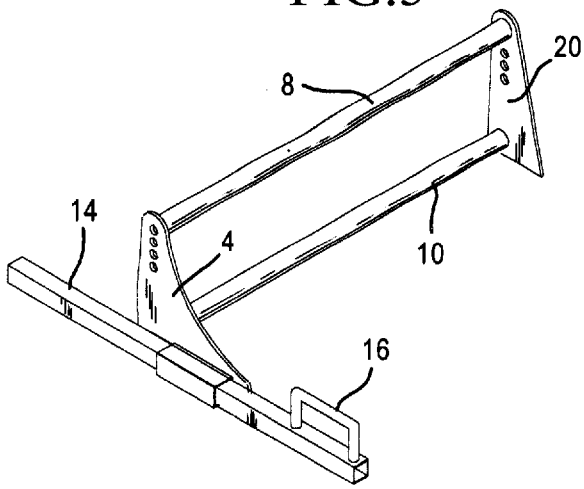
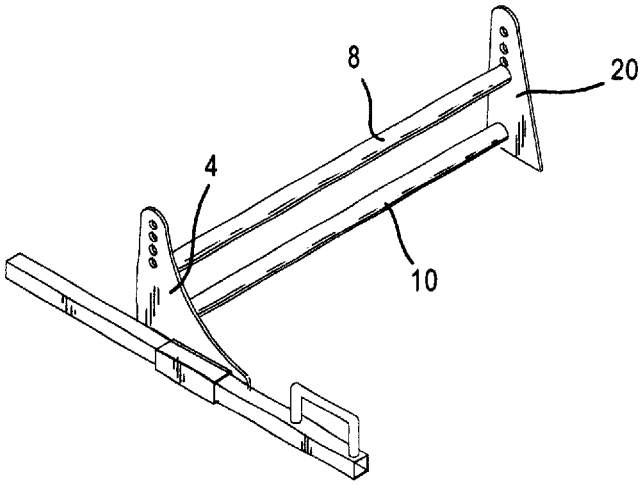
FIG.6

MOTORCYCLE STAND

TECHNICAL FIELD

This invention relates to a motorcycle stand, and in particular, to a motorcycle stand, which may be placed beneath the motorcycle and then with the rider in a position astride it, the motorcycle may be moved to a secondary position, wherein a wheel of the motorcycle is elevated and the stand stabilized. The motorcycle may then be driven off of the stand.

BACKGROUND OF THE INVENTION

When it is desired to work on a motorcycle, whether it is maintenance, repair or cleaning, it is desirable to have the motorcycle in an elevated position and stable.

There are several motorcycle stands on the market, which function reasonably well for their intended purpose, however, the drawbacks to these stands, known to the inventor, are that the stand must be put into position while the operator is off the motorcycle, requiring the operator to balance the motorcycle with one hand while manipulating the stand to elevate the motorcycle with the other hand. At a weight of up to 900 pounds, this one handed manipulation is precarious at best. Since these stands, with the cycle mounted on them lack stability, the person working on the motorcycle must constantly be aware of the danger and cannot completely concentrate on the task at hand. When the rider wishes to remove his bike from the lift, the operation must be repeated, and because of the awkward position, the operator is in further danger of losing control of the cycle.

Additional prior art known to the inventor include hydraulically or pneumatically operated lifts, which are bulky, heavy and expensive, and lift the entire cycle.

SUMMARY OF THE INVENTION

With above-noted prior art and problems in mind, it is an object of the present invention to provide a motorcycle stand that enables the rider to place the motorcycle upon and remove it from the stand while standing astride the cycle.

It is another object of the present invention to provide a motorcycle stand that is simple of construction, easy to use and safe.

Still a further object of the present invention is a motorcycle stand that is easy to transport and store and safe to use.

It is still a further object of the present invention to provide a motorcycle stand which is adjustable in height, stable when in use, and easy to mount and dismount.

Still a further object of the present invention is to provide a motorcycle stand, wherein the crank rod, which is used to elevate the motorcycle upon the stand, is also used to stabilize the stand when in use, and further, make it simple and safe to remove the cycle from the stand when it is time to dismount the motorcycle.

BRIEF DESCRIPTION OF THE DRAWINGS

FIG. 4 is an illustration of the stand in its operating position without the motorcycle for clarity.

FIG. 5 is an illustration of the stand in its operating position with the handle moved to a stabilizing location.

FIG. 6 is an illustration of the stand with the motorcycle support bar moved to an alternate position.

BEST MODE FOR CARRYING OUT THE INVENTION

Figure 1:
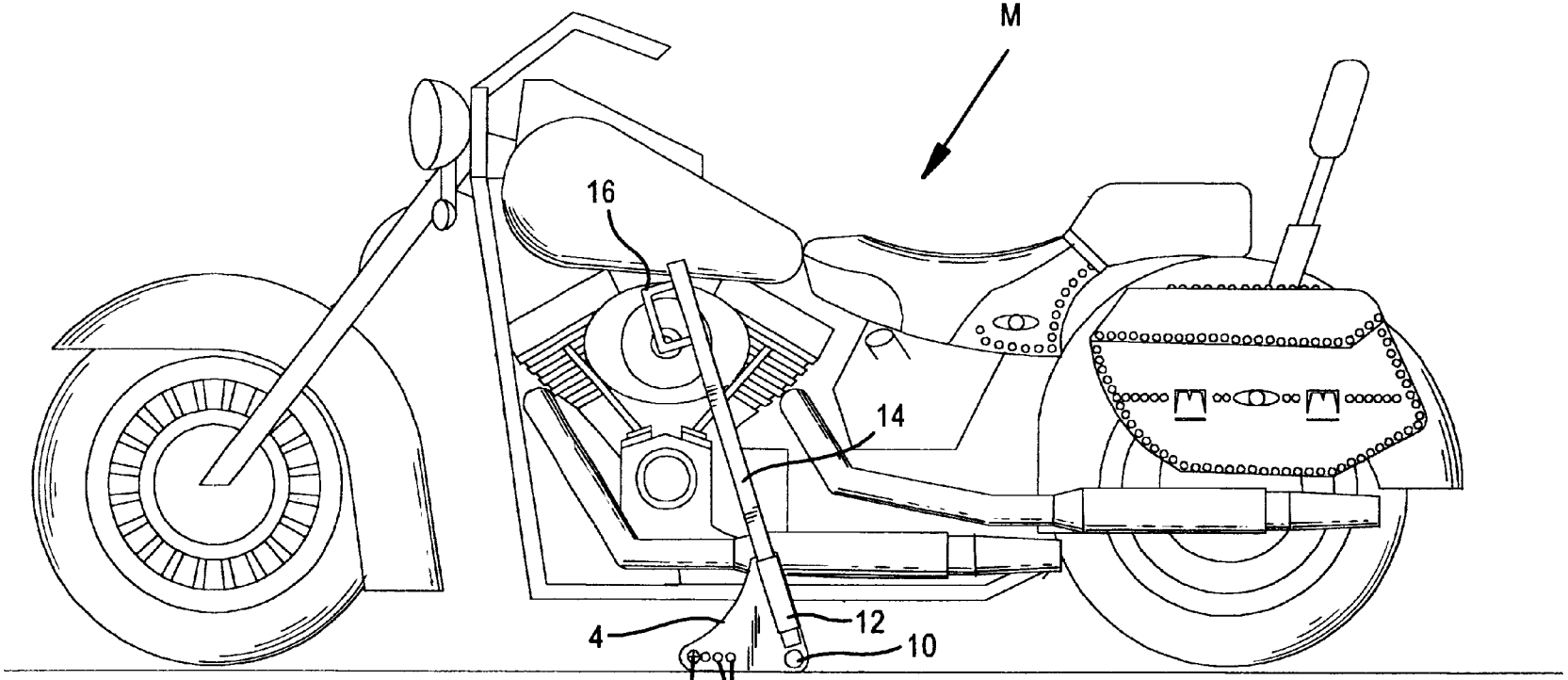
FIG. 1 is a depiction of a motorcycle with the stand in position beneath the cycle in the dismount position.

As seen in FIG. 1, there is depicted a motorcycle M, which is in position over the stand 2 which has been slid beneath the motorcycle. As explained in greater detail hereinafter, the stand includes a substantially triangular shaped side piece 4 which includes a plurality of openings 6 along one side thereof, one of which is occupied by a cycle supporting cross rod 8, which may be moved to any one of the openings 6 if desired. A rigid connecting rod 10 likewise interconnects the side plate 4 with its counterpart at the opposite side of the stand and is located at the fulcrum point of the stand (not shown) as explained hereinafter.

A sleeve element 12 telescopically receives a crank rod 14, which likewise includes a handle 16.

Figure 2:
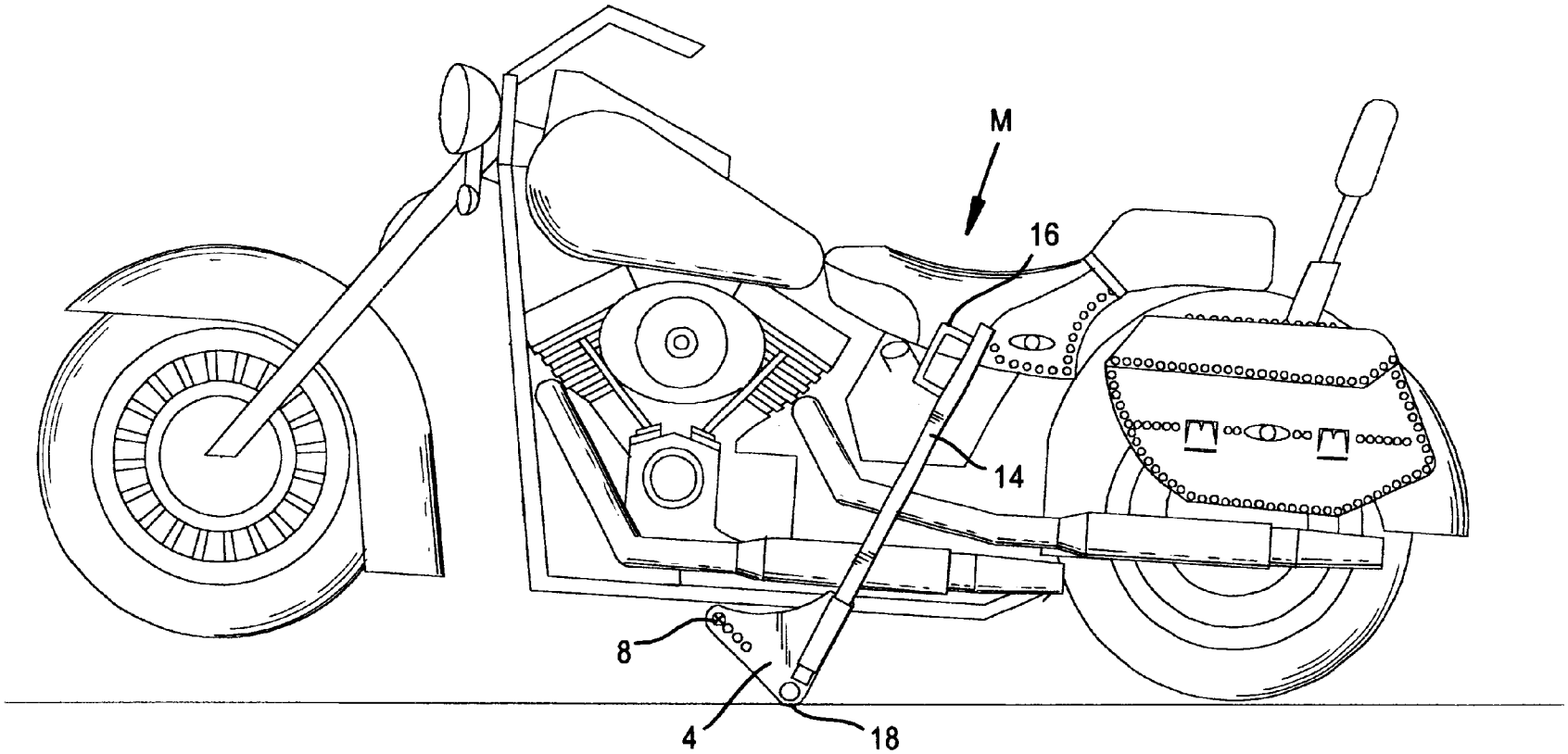
FIG. 2 is an illustration of the stand being moved from the dismount position to the mount position, elevating the motorcycle.

Reference is now had to FIG. 2, wherein the motorcycle M shown in a partially elevated position, the handle 16 having been used to push the crank rod 14 rearwardly of the motorcycle, causing the motorcycle support rod 8 to contact the frame of the under side of the motorcycle pivoted around the rounded corner 18 of sideplate 4.

Figure 3:
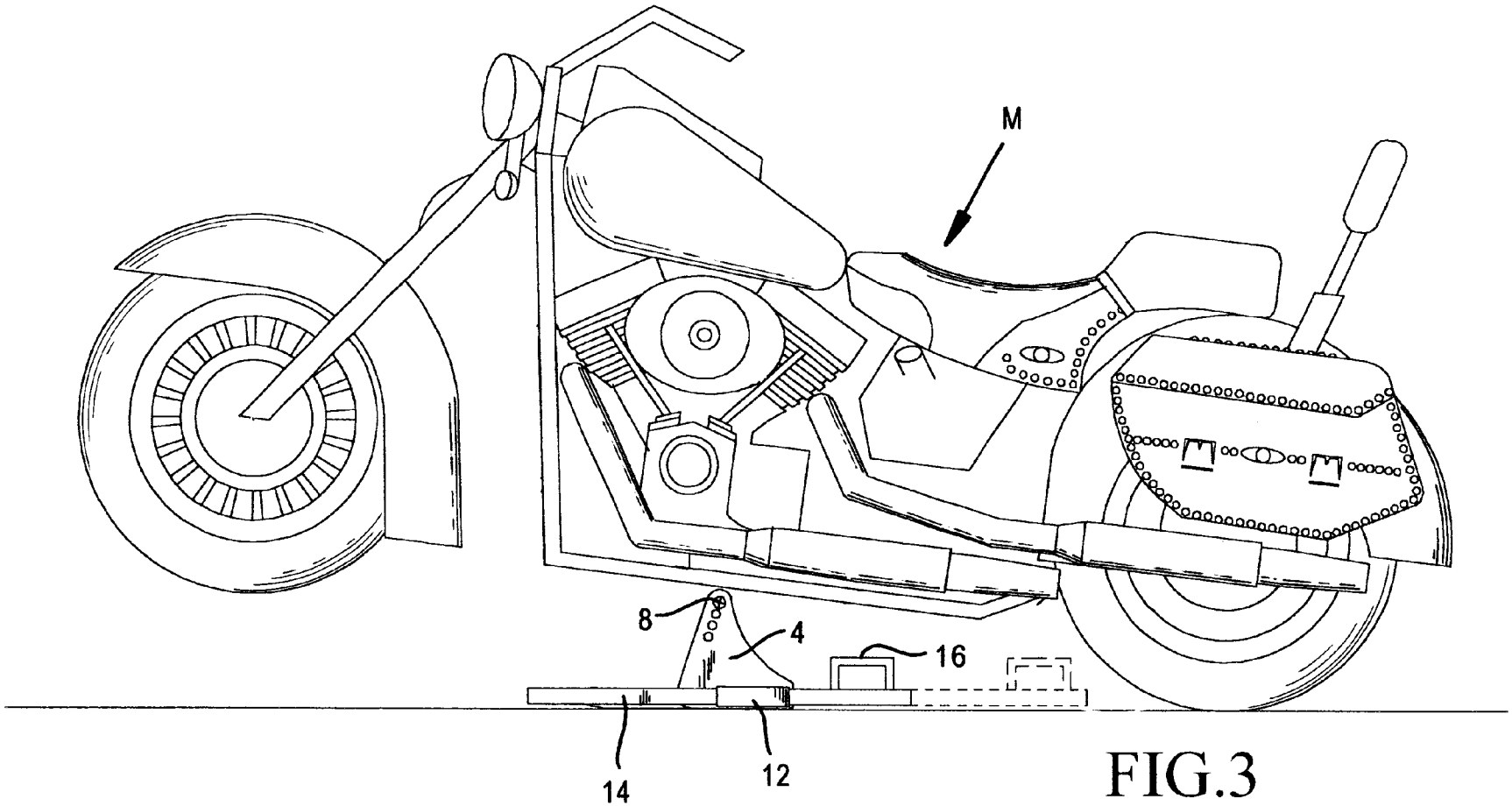
FIG. 3 is an illustration of the motorcycle and stand with the stand supporting the motorcycle and the handle moved to a position for stability.

Attention is now directed to FIG. 3, wherein the motorcycle M is in its fully raised position resting upon the adjustable cross bar 8 and the side of the substantially triangular shaped sideplate 4 containing the sleeve 12 that has been pivoted to the ground and the crank rod 14 has been slid into the sleeve so that it extends on both sides of the sleeve, providing a stabilizer for the stand, and thus the motorcycle.

As indicated hereinabove, the entire operation of lifting can be handled with the rider sitting in the saddle of the motorcycle, whereby enabling him or her to stabilize the motorcycle with the legs and feet or can be accomplished from alongside. When it is time to remove the motorcycle from the stand, the rider simply kicks the handle out of the sleeve while astride the cycle and rolls the motorcycle forward, causing the stand to reverse pivot to the position as shown in FIG. 1 sans the handle and lever arm.

Reference is now had to FIGS. 4 and 5, wherein in addition to the parts enumerated in FIGS. 1–3, it can be seen that a second sideplate 20 supports the opposite ends of cross rods 8 and 10, forming a rigid structure which supports a motorcycle as described hereinabove.

In FIG. 4, the rod and handle are in the position utilized for lifting the motorcycle and in FIG. 5 the rod and handle are in a position to stabilize the cycle in the raised position.

FIG. 6 is another view similar to FIG. 5, only the cross rod 8 has been adjusted downwardly.

Thus, as can be seen, the present invention provides a simple, effective and safe means for raising a motorcycle for maintenance or other functions.

What is claimed is:

1. A stable motorcycle stand movable from a first position beneath a motorcycle to a second position supporting the motorcycle, comprising:

a pair of parallel side plates, wherein the side plates are generally triangular in configuration to form a stable platform, and a first one of the angles is approximately 90° smoothly interconnecting two adjacent working sides;

a first interconnecting element extending between the side plates adjacent the first angle;

a second interconnecting element at the opposite end of one of the working sides, said second interconnecting element securable at a select one of at least two adjacent bores;

a sleeve rectangular in cross section rigidly secured to one of the side plates along the other working side; and an elongated crank rod including a handle telescopically received in said sleeve in a first location for moving the stand from the first position to the second position and a second location stabilizing the stand in the second position.

2. A stable motorcycle stand, including a removable crank rod element enabling a user to move the motorcycle to and from a supported position while mounted upon the motorcycle stand, comprising:

a pair of substantially triangular parallel side plates, to form a stable platform when the motorcycle is supported, held in relative spaced position by a pair of parallel bars, extending between adjacent angles of the side plates, wherein one of the angles adjacent one of the parallel bars is approximately ninety degrees and includes a smooth rounded angle surface; and a sleeve member of rectangular cross section substantially parallel to the side of one of the side plates adjacent the approximately ninety degree angle to telescopically receive a crank rod, including a handle member and from a first position rotate the stand from a first orientation where it easily slides beneath a motorcycle frame to a second orientation supporting the motorcycle, and a second position stabilizing the stand from which the crank rod may easily be removed, allowing the motorcycle to rock off the stand.

* * * * *

UNITED STATES PATENT AND TRADEMARK OFFICE

CERTIFICATE OF CORRECTION

PATENT NO. : 6,581,784 B1
DATED : June 24, 2003
INVENTOR(S) : John T. Pino

It is certified that error appears in the above-identified patent and that said Letters Patent is hereby corrected as shown below:

Title page,
Item [73], Assignee, should read -- JTP Enterprises LLC --

Signed and Sealed this

Sixth Day of April, 2004

JON W. DUDAS
*Acting Director of the United States Patent and Trademark Office*